United States Patent [19]

Rau et al.

[11] 3,967,986

[45] July 6, 1976

[54] METHOD OF PREPARING FERROMAGNETIC MATERIAL

[75] Inventors: Hans Rau, Aachen-Laurensberg; Karl-Georg Knauff, Aachen, both of Germany

[73] Assignee: U.S. Philips Corporation, New York, N.Y.

[22] Filed: Jan. 27, 1975

[21] Appl. No.: 536,162

[52] U.S. Cl. ..... 148/105; 34/168; 75/.5 AA; 75/.5 BA

[51] Int. Cl.[2] ..... H01F 1/02

[58] Field of Search ..... 75/.5 AA, .5 A, .5 BA; 148/105, 103; 34/168

[56] References Cited

UNITED STATES PATENTS

| | | | |
|---|---|---|---|
| 2,730,441 | 1/1956 | Crowley | 75/.5 AA |
| 3,598,568 | 8/1971 | Klomp et al. | 75/.5 AA |
| 3,837,839 | 9/1974 | Rau et al. | 75/.5 AA |

FOREIGN PATENTS OR APPLICATIONS

| | | | |
|---|---|---|---|
| 1,104,852 | 3/1968 | United Kingdom | 34/168 |

*Primary Examiner*—Walter R. Satterfield
*Attorney, Agent, or Firm*—Frank R. Trifari; Carl P. Steinhauser

[57] ABSTRACT

A method of preparing iron powder for recording in which iron oxide hydrate powder is reduced by flowing hydrogen in intimate contact with the iron oxide hydrate powder, preferrably in a fluidized bed.

5 Claims, 4 Drawing Figures

METHOD OF PREPARING FERROMAGNETIC MATERIAL

The invention relates to a method of preparing ferromagnetic material which shows the form of a powder of acicular particles consisting at least predominantly of iron, by reduction of iron oxide powder and/or iron oxide hydrate powder possibly containing additives, by means of a gaseous reduction agent which predominantly contains hydrogen.

Such ferromagnetic materials are used, for example, in the manufacture of magnetic information memories (magnetic tapes, magnetic discs). Said materials contain, for example, Ge, Sn, Al, Ag, Ni and Co as additives.

U.S. Pat. No. 3,598,568 describes reducing tin-doped acicular iron oxide hydrate with flowing hydrogen at 250°–500°C. As appears from the examples of the patent, flowing quantities of hydrogen of approximately 650 liters per hour and per gram of Fe contents of the oxide hydrate are used. Such large flowing quantities of hydrogen have a negative influence on the efficiency. When the quantity of flowing hydrogen is reduced, an extension of the reduction time is to be expected which, in the said example, is at least 60 minutes. Extension of the duration of the thermal treatment increases the possibility of sintering so that the quality of the ferromagnetic material, in particular the applicability as a storage material, is adversely influenced. Moreover, sintering increases when the temperature increases.

It is the object of the invention to obtain a shortening of the reduction time in spite of a reduction of the flowing quantity of hydrogen, without the above-mentioned loss of quality occurring thereby.

According to the invention, the gaseous reduction agent is intimately contacted with the material to be reduced, and the flowing quantity of gaseous reduction agent in relation to the material to be reduced corresponds at least to the formula $V = 0.4 \times T - 120$, where $V$ is the volume in liters of the quantity of gaseous reduction agent at 0°C and 1 atm. which flows per hour and per gram of Fe contents of the material to be reduced, and $T$ is the reduction temperature in °C, $T$ being between 300° and 600°C.

The intimate contact between gaseous reduction agent and material to be reduced results in that the reduction time achieves a minimum with the temperature, the quantity of flowing reduction agent and Fe contents being maintained constant. The influence of the volume of the quantity of flowing reduction agent will be described hereinafter. It is to be noted, however, that the upper limit of the volume is determined only by economical considerations.

In a favourable embodiment of the method according to the invention which is advantageous in the range between 300° and 400°C, reduction may be carried out in a single-stage fluidised bed.

On the basis of the above-mentioned formula, such large flowing quantities occur at higher temperatures and in certain circumstances (so large velocities of the reduction gas), that the range of the fluidised bed is left (the possibility exists that the powder is blown out of the reaction vessel). In order to remain within the range of the method according to the invention the filling mass is to be reduced at higher temperatures.

The very short reduction times occurring then make it useful to change from discontinuous to continuous operation because otherwise filling and emptying will consume more time than the reduction itself. The continuous method may of course also be used at temperatures below 400°C.

A favourable embodiment of such a continuous operation is the performance of the method according to the invention in a tilting furnace. Such a tilting furnace is known per se from British Pat. Specification No. 1,104,852.

The invention will be described with reference to the accompanying drawings in which.

Figure 1:
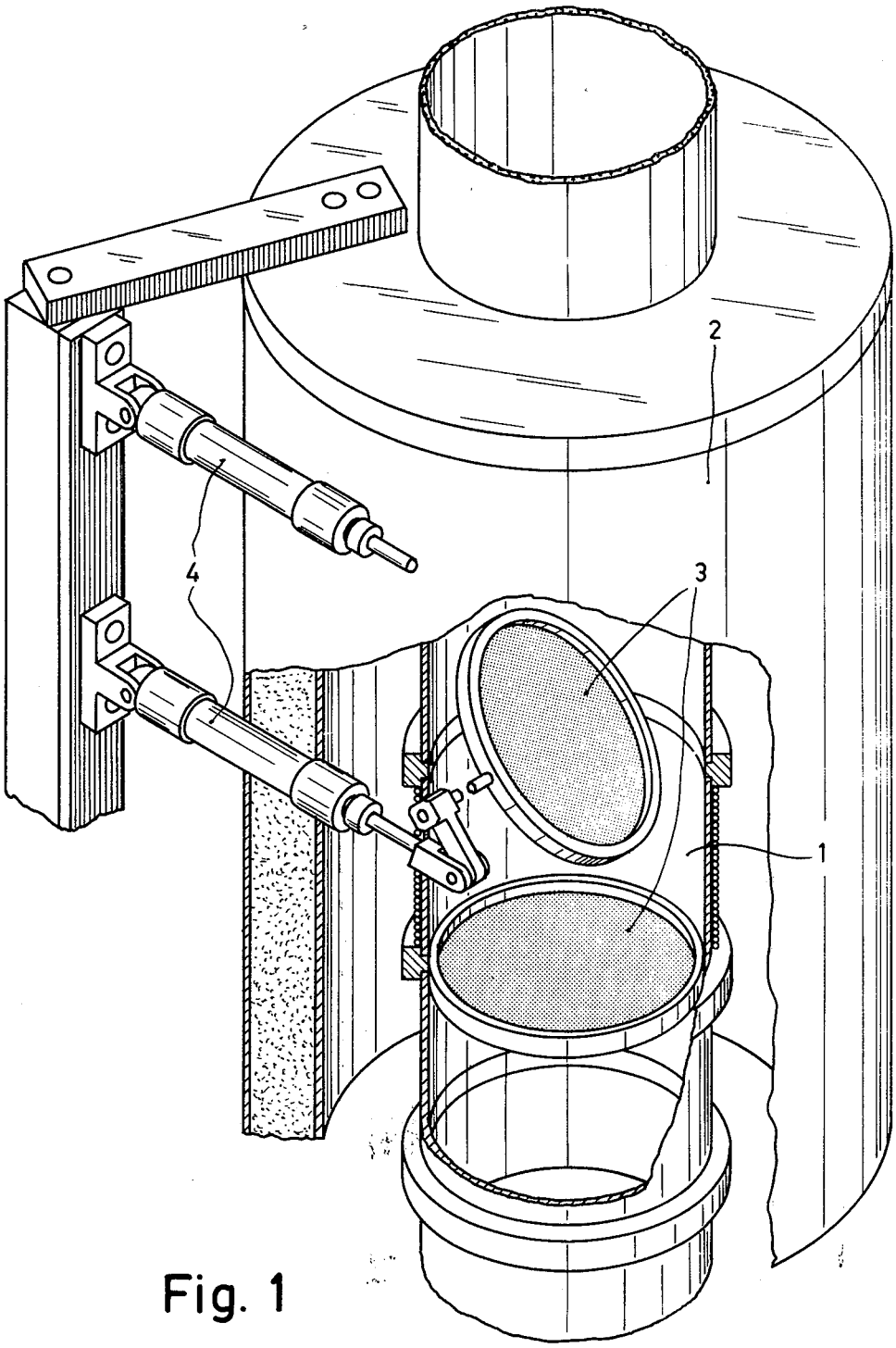
FIG. 1 shows a filtering furnace

An example of such a tilting furnace is shown in FIG. 1. In this Figure, reference numeral 1 denotes a reduction tube which is surrounded by a jacket 2 and in which preheated hydrogen enters from below. $\alpha$-FeOOH powder is supplied from the top on a tiltable sieve bottom 3 in a layer of approximately 2 mm thickness (which, with a diameter of the sieve bottom of 100 mm, corresponds to approximately 8 gram Fe contents). The transport of the powder against the flow of hydrogen occurs by tilting the individual bottoms by means of a tilting device 4. The tilting operation is programmed. First the lowest bottom is tilted through approximately 120° and empties the reduced powder in a container present for that purpose (not shown), the bottom is tilted back and the second lowest bottom is tilted to transport its powder to the lowest bottom, and so on. When the upper sieve bottom is empty, fresh $\alpha$-FeOOH powder is supplied by a dosing device. The overall duration is determined by the length of the pause between each tilting cycle.

Figure 2:
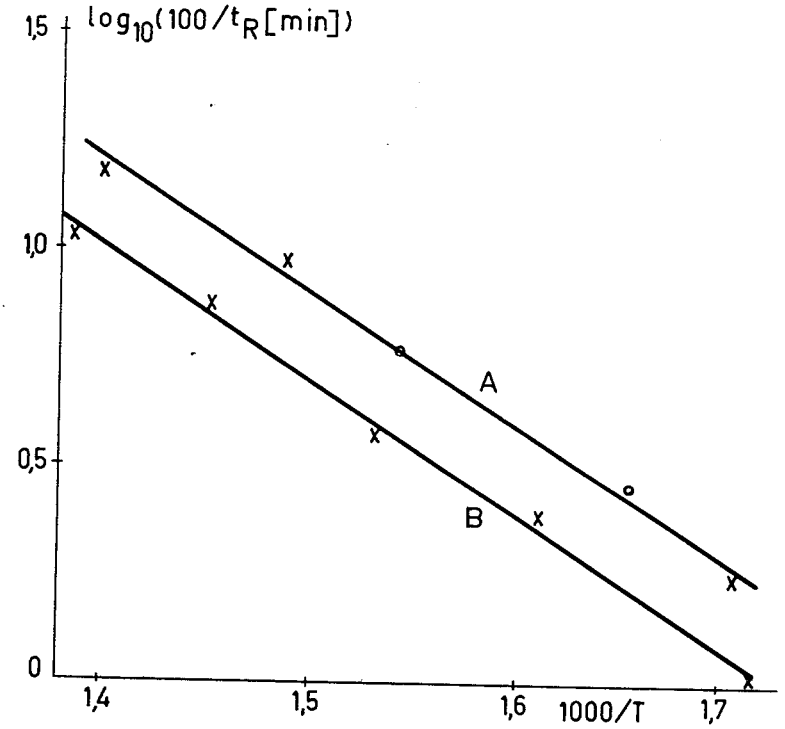
FIG. 2 shows the reduction rate dependence upon temperature of two different powders

FIG. 2 shows how the reduction rate depends upon the temperature T for two different $\alpha$-FeOOH powders A and B. (Reduction time is to be understood 100 divided by the stay $t_R$ in minutes which is necessary to obtain 95% iron content in the final product. In order to cause the iron content to rise above 95%, the stay would have to be increased more than proportionally, which, due to the associated possibility of sintering, is not interesting technically.) In most experiments a sieve fraction of grain sizes if 500 to 1000 $\mu$m (denoted in the Figure by $x$) was used, in two cases 300–500 $\mu$m (denoted in the Figure by $o$). 9m$^3$ of $H_2$ per hour was always used, which corresponds to approximately 110 liters $H_2$ per hour and per gram of Fe contents. Both powders are tin-doped; in case A 1.3% Sn, in case B 1.7% Sn. The term "powder" is to be understood to include within the scope of this invention also granulates, such as they occur, for example, in preparing acicular doped $\alpha$-FeOOH.

Figure 3:
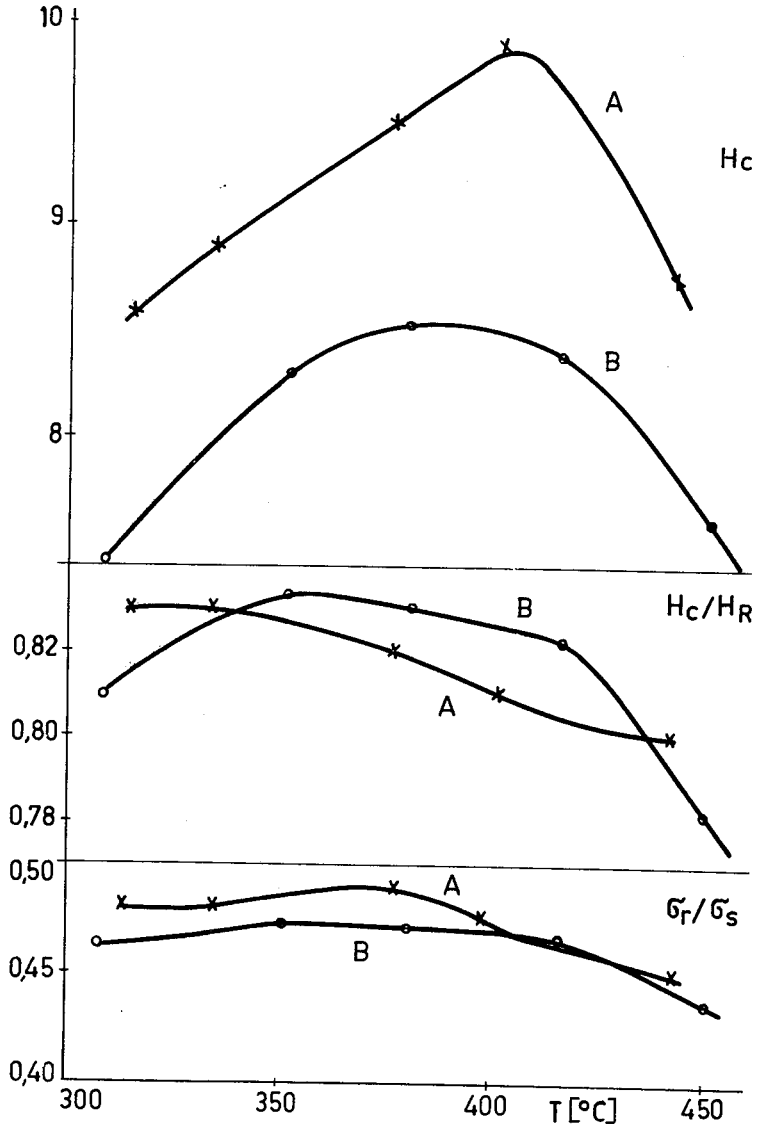
FIG. 3 shows the coercive force and remanent magnetization expressed as a function of temperature

FIG. 3 shows the coercive force $H_c$ expressed in $10^{-4}$A/m as a function of the reduction temperature T, the ratio $H_c/H_r$, where $H_r$ is the remanent coercive force, as a function of T and the remanent magnetization ratio $\sigma_r/\sigma_s$ s as a function of T for the same powders A and B after these are no longer pyrophoric (stabilized with $N_2/O_2$ at a temperature smaller than or equal to 40°C). It appears that a maximum for $H_c$ occurs, while the other quantities show only a small temperature dependence. So the best powders were obtained at approximately 400°C (powder A) and at 380°C (powder B).

The performance of the method according to the invention in such a tilting furnace couples the advantages of a rotating tube furnace (counter-current principle, continuous operation) with those of a fluidised bed method (good material transfer and heat transfer, particularly rapid removal of the reaction water) without exhibiting the drawbacks thereof (poor contact between reduction gas and oxide in the rotating tube furnace, discontinuous operation in the fluidised bed). Moreover, the very uniform time of stay of all the particles is to be emphasized.

In another possibility of such a continuous counter current method, several endless transport belts placed one above the other are used which have a possibility of passing the reduction gas which flows in from below. The material to be reduced is introduced at the top in a thin layer and falls down in a zig-zag manner and finally in a storage container due to the movement of the transport belts which preferably travel alternately in opposite directions.

A preferred embodiment of the method according to the invention is therefore characterized in that the material to be reduced is transported from the top to the bottom in counter current with the gaseous reduction agent, sieve surfaces which are in the form of endless transport belts being moved so that the material falls each time from one sieve surface on the next one and into a storage container, respectively.

In this embodiment it is particularly advantageous that successive surfaces which are partly shifted relative to each other are moved in opposite senses.

Figure 4:
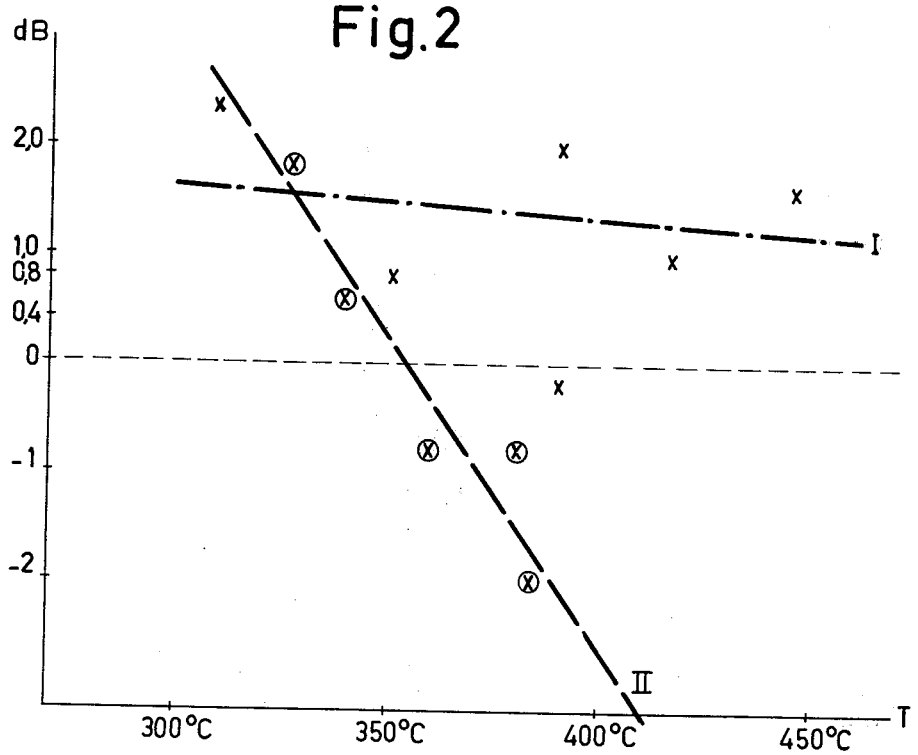
FIG. 4 shows the relationship of the signal-to-noise ratio to temperature.

FIG. 4 shows the results of measurements of magnetic tapes which comprise acicular iron prepared according to the method of the invention. Shown is the signal-to-noise ratio (signal at 3 $\mu$m, noise at 16 $\mu$m wave-length in dB, compared with a $CrO_2$ tape (0 dB, commercially available) as a function of the reduction temperature. Curve I relates to a tilting furnace which was operated within the whole range of the method according to the invention (110 liters of $H_2$ per hour and per gram of Fe contents). Curve II shows values of tapes of which the iron powders had been prepared in a single-stage fluidised bed, in which approximately 14 liters of $H_2$ per hour and per gram of Fe contents were used. In this case, the above-mentioned formula gives as an upper limit for the usability of the method according to the invention in said fluidised bed a temperature of approximately 335°C. It is obvious from FIG. 4 that in a fluidised bed method at temperatures above 335°C and an $H_2$/Fe ratio which remains the same, so when the range according to the invention is left, the quality of the tapes decreases very rapidly.

The use of higher temperatures is of advantage still for other reasons: due to the exponential increase of the reduction as a function of the temperature (FIG. 2), the consumption of hydrogen ($H_2$ consumption per gram of reduced Fe) actually is considerably more favourable.

What is claimed is:

1. A method of preparing ferromagnetic material in the form of acicular particles consisting at least predominantly of iron, comprising the steps of reducing an iron oxide or iron oxide hydrate powder by intimately contacting the powder with a quantity of a gaseous reduction agent which predomimantly contains hydrogen flowing at a rate corresponding at least to the formula $V = 0.4 \times T - 120$, where $V$ is the volume in liters of the quantity of gaseous reduction agent at 0°C and 1 atm. which flows per hour and per gram of Fe contents of the material to be reduced, and $T$ is the reduction temperature in °C, $T$ being between 300° and 600°C.

2. A method as claimed in claim 1, wherein the reduction is carried out at temperatures between 300° and 400°C in a single-stage fluidised bed.

3. A method as claimed in claim 1, wherein the reduction is carried out in a tilting furnace.

4. A method as claimed in claim 1, wherein the powder is transported from the top to the bottom in counter current with the gaseous reduction agent, and deposited, after successively passing through a plurality of sieves, into a storage container.

5. A method as claimed in claim 4, wherein successive sieves move relative to each other in opposite directions.

* * * * *